United States Patent [19]

Erickson

[11] 4,381,175

[45] Apr. 26, 1983

[54] JET ELECTRIC PUMP

[75] Inventor: John W. Erickson, Huntington Beach, Calif.

[73] Assignee: Kobe, Inc., Huntington Park, Calif.

[21] Appl. No.: 185,824

[22] Filed: Sep. 11, 1980

[51] Int. Cl.[3] ..... F04B 23/08

[52] U.S. Cl. ..... 417/80; 417/89

[58] Field of Search ..... 417/76, 78–84, 417/89, 160, 244, 245, 424, 423; 415/168, 199.1, 121 R, 121 A, 121 G; 60/39.09 P

[56] References Cited

U.S. PATENT DOCUMENTS

| | | | |
|---|---|---|---|
| 2,056,994 | 10/1936 | Woods | 417/79 |
| 2,763,281 | 9/1956 | Morgan | 417/80 X |
| 2,812,715 | 11/1957 | Redding et al. | 417/80 X |
| 2,845,028 | 7/1958 | Nash et al. | 417/83 X |
| 2,853,013 | 9/1958 | Lung | 417/81 X |
| 4,294,573 | 10/1981 | Erickson et al. | 417/83 |

*Primary Examiner*—Edward K. Look

*Attorney, Agent, or Firm*—Norvell, Jr., William C.

[57] ABSTRACT

A pump assembly for limited production wells comprises an electric motor driven centrifugal pump having a controlled amount of recirculation through a jet pump. The recirculated fluid is the power fluid for the jet pump, which aspirates production fluid. The combined output of the jet pump is discharged to the centrifugal pump inlet. An electrically actuated valve in the recirculation path controls the amount of recirculation, permitting low well flow rates to be compensated for by high recirculation rates, and variation of the valve position is accomplished from the well head by the imposition of a DC signal on the AC power line for the pump motor.

3 Claims, 2 Drawing Figures

JET ELECTRIC PUMP

BACKGROUND OF THE INVENTION

1. Field of the Invention

The invention relates to submersible electric centrifugal pumps.

2. Description of the Prior Art

Submersible electric cenrifugal pumps are commonly used downhole in a well, to pump production fluid to the surface. Typically, such pumps operate most reliably and efficiently at flow rates of about 600 barrels per day. Many wells, however, produce only small quantities of oil, on the order of 150 barrels per day, or less.

At less than optimum flow rates, a pump is not only less efficient, but motor cooling is reduced in proportion to reduced fluid flow. The danger of motor failure through overheating becomes significant.

Recirculation of pump output has been used to achieve the necessary flow rate through the pump. In one system, described in U.S. Patent Application Ser. No. 039,775, filed May 17, 1979, now U.S. Pat. No. 4,294,573 assigned to the assignee of this Application, a portion of the output of one or more electrical centrifugal pumps is recirculated as power fluid through a jet pump. The jet pump aspirates production fluid, and its entire combined output flows to the centrifugal pump inlet. It may be preferable that the inlet of the jet pump be fed by an auxiliary centrifugal pump, to prevent cavitation. The system adapts pumps having relatively high flow requirements to wells producing at a relatively low rate. Thus the flow rate through the centrifugal pump, including recirculated fluid, is consistent with optimal operation of the pump, while the small portion of the pump output diverted to the surface may be equal to the ideal well production rate.

Such an assembly of a jet pump and electrically powered centrifugal pumps comprises pump components chosen for the expected well conditions. When it is desired to change the pumping characteristics of the pump assembly, as the well is pumped off, for example, it has been necessary to substitute another jet pump in the downhole assembly. To facilitate the substitution of a different size jet pump to suit the changed well requirements, the jet pump is disposed uppermost in the assembly, even though it is intermediate in the fluid flow path. Accordingly, while the characteristics of the pump assembly could be tailored to well requirements without removal of the complete assembly, a time consuming retrieval and substitution operation for the jet pump component was necessary.

SUMMARY OF THE INVENTION

The invention provides a downhole pump assembly, the pumping characteristics of which can be changed by electrical control from the surface, without the necessity of retrieval operations. The invention comprises an assembly of a jet pump and centrifugal pumps, in which the amount of recirculation through a high pressure centrifugal pump can be controlled by an electrically actuated valve. The high pressure centrifugal pump comprises a plurality of pump stages powered by a submersible downhole electric motor. To permit the high pressure centrifugal pump to operate in its optimum range with limited production fluid, most of the output of the pump is recirculated. In the recirculation path, the high pressure output from the centrifugal pump is utilized to power the jet pump. The jet pump aspirates the output from a low pressure centrifugal pump, which is driven by the common electric motor. The low pressure centrifugal pump pumps fluid from the production zone, thus providing sufficient charging pressure to the jet pump to avert cavitation.

Production flow is thus pumped through the primary, low pressure centrifugal pump, through the jet pump, which is powered by the recirculating stream, and through the high pressure stages of the high pressure centrifugal pump. A small portion of the output of the high pressure centrifugal pump is pumped to the surface through the production string. Most of the high pressure output is diverted as the recirculating stream to power the jet pump. The output from the jet pump combines both the recirculating stream and pumped aspirated production fluid to feed the high pressure centrifugal pump.

To control the amount of recirculation, a needle valve is disposed in the recirculating line between the high pressure centrifugal pump outlet and the power inlet to the jet pump. A solenoid selectively actuates the valve to either an open position providing high recirculation to match low well production rates, or a constricted position providing relatively low recirculation to match high well production rates. The solenoid responds to a DC signal from the surface, which may be imposed on the same power lines carrying the AC current to the pump motor.

DESCRIPTION OF THE PREFERRED EMBODIMENTS

Figure 1:
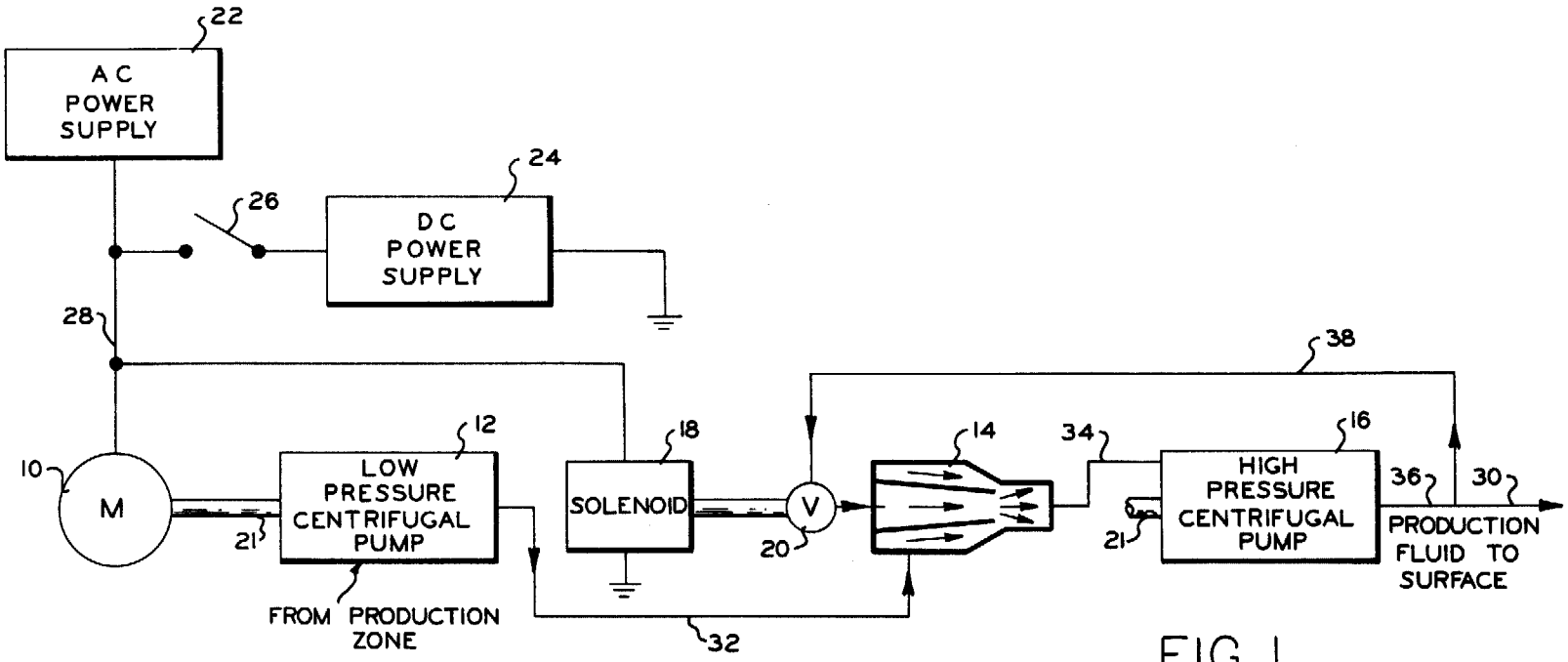
FIG. 1 is a schematic block diagram of the jet and centrifugal pump assembly, and the associated electrically actuated valve control apparatus.

Referring to the drawing, the downhole components of the electrically controlled pump apparatus comprise an AC motor 10, a low pressure centrifugal pump 12, a jet pump 14, a high pressure centrifugal pump 16, a solenoid 18, a needle valve 20, and associated fluid and electrical lines. These elements are disposed in a housing suitable for downhole residence, as illustrated and more fully described in the aforesaid U.S. patent application Ser. No. 039,775, the disclosure of which is herein incorporated by reference. The two centrifugal pumps 12 and 16 are ganged on a single shaft 21, and rotatively driven by the AC motor 10.

At the surface is an AC power supply 22, a DC power supply 24, and a control switch 26. Electrical conduits 28 carry current to the pump assembly, and are typically run alongside a production tubing string 30.

The pump assembly is located within the well casing (not shown) with the low pressure centrifugal pump 12 adjacent a production zone. The pump 12 pumps oil from perforations in the well casing, through a discharge line 32 to the inlet of the jet pump 14. The low pressure centrifugal pump 12 provides a sufficient charging pressure to prevent cavitation within the jet pump 14. The discharge line 34 receives the relatively high pressure output from the jet pump 14, which combines both the aspirated and power fluids.

The line 34 conducts the fluid discharge from the jet pump 14 to the inlet of the high pressure centrifugal pump 16. The centrifugal pump 16 comprises a plurality of pump stages, and may have an optimum performance range of 600 barrels per day, for example. To match the pump characteristics to a relatively low production well, a recirculation path is provided. Discharge line 36 from the centrifugal pump 16 branches into a recirculation line 38 and the production string 30 which carries the production fluid to the surface. The high pressure recirculating fluid passes through the line 38 and provides the power fluid for the jet pump 14. As mentioned, the exhausted power fluid is combined with the aspirated fluid from the low pressure centrifugal pump 12 and recirculated to the centrifugal pump 16.

The appropriate amount of recirculation for well conditions is initially provided for by selection of pump components, when making up the pump assembly at the surface. Jet pumps having different sizes and characteristics may be chosen to effect the amount of recirculation fluid diverted into line 38 from discharge line 36. When the pump assembly is set within the well, the needle valve 20 in the recirculation path provides means to change the pumping characteristics from the surface.

The needle valve 20 controls the area of the inlet nozzle for the recirculated fluid for the jet pump 14. Needle valve 20 comprises an axially movable pintle or needle in the orifice of the nozzle. The pintle is spring biased to one of two positions, and is actuated to the second position when the solenoid 18 is energized.

Figure 2:
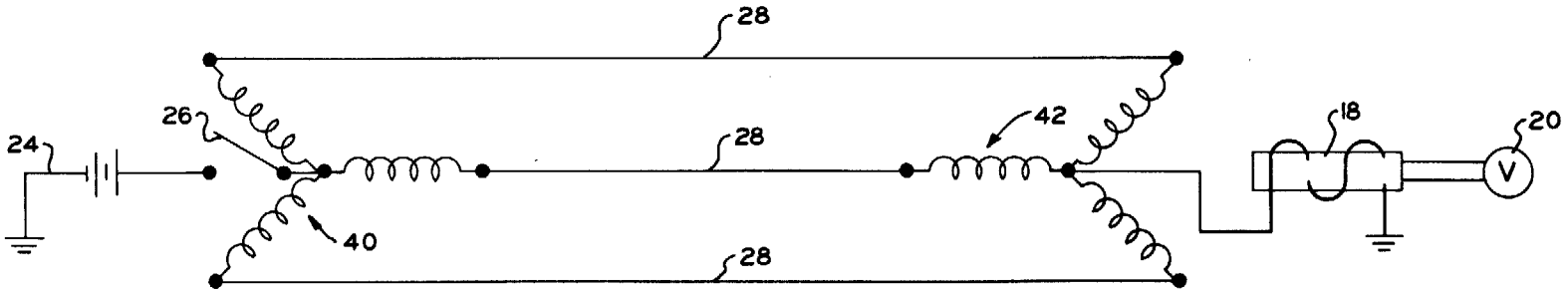
FIG 2 is a schematic diagram of the electrical power supply and control circuitry.

As illustrated schematically in FIG. 2, the solenoid 18 is energized by a DC signal imposed on the power lines 28 carrying the AC current to the pump motor 10. The three-phase AC power supply 22 includes secondary star windings 40 of a Y-connected, three-phase transformer. Lines 28 carry current to corresponding Y-connected windings 42 of the motor 10. A DC power supply 24 is connected in series with switch 26 across the neutral central terminal of the transformer windings 40 and ground. Solenoid 18 is connected across the neutral, central terminal of the motor winding 42 and ground. The solenoid 18 is DC responsive, and can be energized or de-energized by means of the switch 26. Such energization shifts the needle valve 20 to its second position.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An electrically controlled jet pump assembly adapted for downhole residence in a well comprising: an electric motor; electrical conduits extending from a wellhead to said electric motor; a centrifugal pump driven by said electric motor and having an outlet directed to a production string and an inlet; a jet pump having an inlet for aspirated fluid, an inlet for power fluid, and an outlet for the combined output of the aspirated and power fluids; means for providing well fluid to said jet pump inlet for aspirated fluid; means connecting said outlet of said jet pump to said inlet of said centrifugal pump; means providing a recirculation path for a portion of the output of said centrifugal pump to said inlet for power fluid of said jet pump; variable flow valve means in said recirculation path, whereby the amount of recirculation fluid can be controlled; and electrical means including said electrical conduits for controlling said variable flow valve means from the well head.

2. The jet pump assembly defined in claim 1 wherein said electrical means for controlling the variable flow valve means includes a solenoid for actuating said valve means.

3. The jet pump assembly defined in claim 2 wherein said electric motor is connected by said electrical conduits to an AC power line and means for imposing a DC signal on said AC power line to control said solenoid.

* * * * *